United States Patent [19]

Saphores Wiedmaier et al.

[11] Patent Number: 4,886,595

[45] Date of Patent: Dec. 12, 1989

[54] PROCESS OF FROTH FLOTATION USING A METHYLENE BISXANTHATE AS A COLLECTOR REAGENT

[75] Inventors: Eugenio A. Saphores Wiedmaier; Arturo G. Gleisner Klempau, both of Vina del Mar; Juan C. Vega de Kuyper; Wladimir A. Mardones Parra, both of Santiago, all of Chile

[73] Assignee: Establecimientos Industrales Quimicos Oxiquim S.A., Chile

[21] Appl. No.: 344,913

[22] Filed: Apr. 28, 1989

[51] Int. Cl.[4] ..... B03D 1/02

[52] U.S. Cl. ..... 209/166; 252/61

[58] Field of Search ..... 209/166, 167; 252/61; 423/26; 75/2

[56] References Cited

U.S. PATENT DOCUMENTS

| | | | |
|---|---|---|---|
| 1,805,855 | 5/1931 | Steven | 209/166 |
| 1,847,367 | 3/1932 | Stevens | 209/166 |
| 1,943,758 | 1/1934 | Douglas | 209/166 |
| 2,061,201 | 11/1936 | MacAfee | 209/166 |
| 4,410,439 | 10/1983 | Gozier | 209/166 |

FOREIGN PATENT DOCUMENTS

| | | | |
|---|---|---|---|
| 464505 | 6/1974 | Australia | 209/166 |
| 2504131 | 10/1982 | France | 209/166 |
| 781202 | 4/1978 | U.S.S.R. | 209/166 |

*Primary Examiner*—David L. Lacey
*Assistant Examiner*—Thomas M. Lithgow
*Attorney, Agent, or Firm*—Philip A. Mallinckrodt; Robert R. Mallinckrodt

[57] ABSTRACT

A process for froth flotation for the recovery of sulfide minerals, or sulfidized oxide minerals, from their ores utilizing a methylene bisxanthate as a collector reagent, either alone or in combination with other known collector reagents in the froth flotation of an aqueous pulp of such ores.

12 Claims, No Drawings

PROCESS OF FROTH FLOTATION USING A METHYLENE BISXANTHATE AS A COLLECTOR REAGENT

BACKGROUND OF THE INVENTION

1. Field

The invention is a process of froth flotation for recovering sulfide minerals, or sulfidized oxide minerals, from sulfide ores containing same, using collector reagents for concentrating the desired minerals in the froth.

2. State of the Art

Froth flotation is a very old and widely used process for recovering sulfide minerals, or, more recently, oxide minerals that have been specially sulfidized for the purpose, from ore concentrates containing such a mineral or a mixture of such minerals, e.g., copper and molybdenite minerals.

Various chemical compounds have been employed as reagents for collecting such a mineral or minerals in the froth of an ore pulp subjected to froth flotation, so as to be recovered in a froth concentrate of the mineral or minerals. Among the chemical compounds widely used as collector reagents are various of the xanthates, such as xanthate esters.

SUMMARY OF THE INVENTION

We have found that methylene bisxanthate compounds having the general formula:

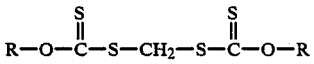

wherein R is an alkyl group containing from one to six carbon atoms, serve admirably as collector reagents for sulfide minerals, or for sulfidized oxide minerals, in the froth flotation of an ore pulp containing same, in comparison with known xanthate collector reagents or other collector reagents.

Such methylene bisxanthate compounds are known and some have been used heretofore in fields far removed from froth flotation. Thus, Cupery et al. U.S. Pat. No. 3,011,887 of Dec. 5, 1961 discloses the use of these compounds as defoliants, particularly for cotton plants prior to the harvesting of the cotton, and Viste et al. U.S. Pat. No. 3,667,931 of June 6, 1972 discloses the use of these compounds as herbicides, particularly for controlling the growth of weeds in rice paddys.

A corollary of the present invention is that disclosed in our concurrently filed and copending application Ser. No. 344912 entitled "Process for Production of Methylene Bisxanthates", wherein is disclosed an especially advantageous process for producing collector reagents useful in this invention.

DETAILED DESCRIPTION OF THE ILLUSTRATED EMBODIMENT

The best mode presently contemplated for carrying out the invention in commercial practice is set forth in the following detailed description of the use of a methylene bisxanthate as the collector reagent in the froth flotation of a copper molybdenum sulfide ore, though it should be realized that this represents merely one example of the various possibilities of mineral recovery in accordance with the invention as disclosed generally herein.

Any of the methylene bisxanthates represented by the general formula:

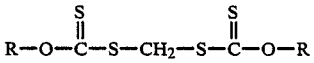

wherein R is any one of an alkyl group having from one to six carbon atoms, can be employed as a collector reagent in a froth flotation process in accordance with the invention. Such a collector reagent can be easily and economically obtained by the process disclosed in our aforesaid application Ser. No. 344912, in contrast to the process described in the aforesaid Cupery et al. U.S. Pat. No. 3,011,887.

In applying the invention to the recovery of a combined copper and molybenum sulfide mineral froth concentrate from a sulfide ore containing the copper sulfide minerals chalcopyrite and chalcocite and the molybdenum sulfide mineral molybdenite using ore of 1.296% Cu and 0.019% Mo from the Andina mine of Codelco-Chile, which was ground to 80% less than 100 mesh and formed into a 34% solids flotation pulp by the addition of water, such flotation pulp was subjected to aeration in a standard flotation cell having a volume of 1500 milliliters operated at an impeller speed of 1500 rpm in the presence of 20 grams per metric ton of methylene bisisopropylxanthate (MBX) as the collector reagent and 27 grams per metric ton of the usual MIBC (methylisobutyl carbinol) froth reagent. The flotation pulp was conditioned for a period of two minutes and then subjected to froth flotation for a period of eight minutes.

The foregoing was repeated using only a standard commercial collector reagent, i.e. isopropyl ethyl thionocarbamate, for comparative purposes, and was repeated again using 70% of the same standard collector reagent and 30% of the MBX as a collector reagent.

The comparative results are shown in the following table:

TABLE

| Flotation Results | Standard Collector | MBX Collector | 70% Standard Collector 30% MBX Collector |
|---|---|---|---|
| Concentrate | | | |
| % Cu | 12.500 | 14.200 | 13.220 |
| % Mo | 0.160 | 0.170 | 0.170 |
| Tailings | | | |
| % Cu | 0.098 | 0.085 | 0.091 |
| % Mo | 0.006 | 0.005 | 0.005 |
| Recovery | | | |
| % Cu | 93.08 | 94.58 | 93.89 |
| % Mo | 74.73 | 76.67 | 75.68 |

It can be seen that, in accordance with the invention, there was an increase in both copper and molybdenum recovery over standard practice with corresponding decrease in copper and molybdenum values lost in the tailings. Moreover, the increased copper recovery produced an increase in copper and molybdenum concentrate grades.

The methylene bisxanthate collector reagent can also be used with at least one other collector reagent during the froth flotation of the sulfide mineral or sulfidized oxide mineral. The at least one other collector can comprise alkyl monothiocarbonates, alkyl dithiocarbonates, alkyl trithio carbonates, dialkyl dithiocarbonates, alkyl thinocarbamates, alkyl dithiocarbamates, dialkyl thioureas, dialkyl and diaryl dithiophosphates, dialkyl monothiophosphates alkyl mercaptans, xanthogen formates, xanthate ester or mercapto benzo thiazoles.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. A process of froth flotation for the recovery of a sulfide mineral, or a sulfidized oxide mineral, from an ore containing said sulfide mineral or sulfidized oxide mineral, comprising subjecting said ore in the form of an aqueous pulp to froth flotation in the presence of a sufficient amount of methylene bisxanthate to act as a collector reagent for said sulfide mineral or sulfidized oxide mineral.

2. A process according to claim 1, wherein the methylene bisxanthate collector reagent is methylene bisisopropylxanthate.

3. A process according to claim 2, wherein there is one or more other collector reagents also present during the froth flotation of the aqueous pulp.

4. A process according to claim 1, wherein there is at least one other collector reagent also present during the froth flotation of the aqueous pulp.

5. A process according to claim 4, wherein the at least one other collector reagent present during the froth flotation of the aqueous pulp is selected from the group of collector reagents consisting of alkyl monothiocarbonates, alkyl dithiocarbonates, alkyl trithiocarbonates, dialkyl dithiocarbonates, alkyl thionocarbamates, alkyl dithiocarbamates, dialkylthioureas, dialkyl and diaryl dithiophosphates, dialkylmonothiophosphates, alkyl mercaptans, xanthogen formates, xanthate esters, and mercaptobenzothiazoles.

6. A process of froth flotation according to claim 1, wherein the sulfide mineral is selected from the group consisting of copper, molybdenum, zinc, and nickel sulfides and sulfidized oxides.

7. A process of froth flotation according to claim 6, wherein the group of sulfide minerals consist of chalcopyrite, chalcocite, and molybdenite.

8. A process of froth flotation for the recovery of a sulfide mineral, or a sulfidized oxide mineral, from an ore containing said sulfide mineral or sulfidized oxide mineral, comprising subjecting said ore in the form of an aqueous pulp to froth flotation in the presence of one or more methylene bisxanthates represented by the formula:

$$R-O-\overset{\overset{\displaystyle S}{\|}}{C}-S-CH_2-S-\overset{\overset{\displaystyle S}{\|}}{C}-O-R$$

wherein R is from an alkyl group containing from one to six carbon atoms in an amount sufficient to act as a collector reagent for said sulfide mineral or sulfidized oxide mineral.

9. A process according to claim 8, wherein there is at least one other collector reagent also present during the froth flotation of the aqueous pulp.

10. A process according to claim 9, wherein the at least one other collector reagent present during the froth flotation of the aqueous pulp is selected from the group of collector reagents consisting of alkyl monothiocarbonates, alkyl dithiocarbonates, alkyl trithiocarbonates, dialkyl dithiocarbonates, alkyl thionocarbamates, alkyl dithiocarbamates, dialkylthioureas, dialkyl and diaryl dithiophosphates, dialkylmonothiophosphates, alkyl mercaptans, xanthogen formates, xanthate esters, and mercaptobenzothiazoles.

11. A process of froth flotation according to claim 8, wherein the sulfide mineral is selected from the group consisting of copper, molybdenum, zinc, and nickel sulfides and sulfidized oxides.

12. A process of froth flotation according to claim 11, wherein the group of sulfide minerals consist of chalcopyrite, chalcocite, and molybdenite.

* * * * *